US006606233B1

(12) United States Patent
Rice et al.

(10) Patent No.: US 6,606,233 B1
(45) Date of Patent: Aug. 12, 2003

(54) METHOD AND APPARATUS FOR IMMUNIZING A CONTACTOR CIRCUIT FROM THE ADVERSE EFFECTS OF A DERIVED POWER SUPPLY

(75) Inventors: Julius Isaiah Rice, Raleigh, NC (US); Roger Alan Plemmons, Knightdale, NC (US)

(73) Assignee: Square D Company, Palatine, IL (US)

( * ) Notice: Subject to any disclaimer, the term of this patent is extended or adjusted under 35 U.S.C. 154(b) by 0 days.

(21) Appl. No.: 09/475,403

(22) Filed: Dec. 30, 1999

(51) Int. Cl.[7] ..... H01H 47/28
(52) U.S. Cl. ..... 361/187; 361/143
(58) Field of Search ..... 361/139, 143, 361/170, 187, 160, 78, 79, 86, 92, 144, 146; 335/226; 327/309, 315, 331; 363/16

(56) References Cited

U.S. PATENT DOCUMENTS 4,706,158 A * 11/1987 Todaro et al. ..... 361/187

5,999,418 A * 12/1999 Gousset et al. ..... 363/125

* cited by examiner

*Primary Examiner*—Kim Huynh
(74) *Attorney, Agent, or Firm*—David R. Stacey; Larry T. Shrout; Larry I. Golden

(57) ABSTRACT

A method and device for immunizing a contactor circuit from the inductive effects of a holding coil derived power supply, including:

sensing a voltage signal from a power supply, the voltage signal having a switching range comprising an upper voltage and a lower voltage;

providing a drive output responsive to the upper voltage; holding the drive output at a constant level as the voltage signal remains above the lower voltage; and, disabling the drive output in response to the voltage signal droppings below the lower voltage.

6 Claims, 10 Drawing Sheets

METHOD AND APPARATUS FOR IMMUNIZING A CONTACTOR CIRCUIT FROM THE ADVERSE EFFECTS OF A DERIVED POWER SUPPLY

TECHNICAL FIELD

The present invention generally relates to contactor circuits. More specifically, to sensing a power supply derived from the contactor's holding coil and immunizing the contactor's circuitry from the adverse effects of transient induction inherent within the contactor circuit.

BACKGROUND OF THE INVENTION

There is a constant desire to increase speed, decrease energy consumption and decrease the amount of physical space required in electrical circuits. Circuit designers are continually redesigning circuits to be faster, smaller and more energy efficient.

One goal circuit designers frequently focus upon is reducing the amount of physical space required for a circuit. Various factors influencing the circuit's design include: power requirements, electric noise, component temperature, timing parameters, etc. Designers frequently utilize a variety of techniques to achieve their design goals. One such circuit design technique is to derive a power supply from the holding coil of a contactor. However, due to the physical structure of the contactor, transient inductive forces generated through normal use of the contactor may adversely affect the performance of the contactor's circuitry coupled to the derived power supply. For example, contactors or relays that utilize dc coils may have electronic circuits which are used to control the device. The contactor's electromechanical coil has resistance and this resistance can be used as a dropping resistor to derive a power supply for the electronics. When the coil resistance is used for the power supply, the power supply is exposed to transient forces, dL/dt, generated by the movement of the contactor's armature.

When an armature moves from an open to a closed position, the movement causes the inductance of the magnetic circuit to increase as the air gap between the magnet and the armature decreases. The dL/dt generates a back electromotive force (EMF) that causes the current in the coil to decrease. Once the armature seals with the magnet, the inductance becomes fixed and the dL/dt decreases to 0. The current in the coil recovers to its initial level. If the contactor control circuit's power supply is derived from the contactor holding coil, the derived power supplied to the contactor control circuit will decrease, or dip, with the contactor's holding coil current. The effect of the transient inductance generated by the derived power supply may turn off the controller circuit when the holding coil current of the contactor decreases, thus causing nuisance tripping.

It is now apparent that the effects of dL/dt cannot be avoided on this type of power supply. If the electronics of the contactor circuit are designed to be tolerant of a power supply decrease due to dL/dt, a power supply derived from the coil resistance can be utilized. To overcome the decreased coil current caused by the inductance created during the closing of the armature, larger filtering capacitors were utilized. However, these larger capacitors occupy valuable physical space. Another filtering technique implemented to combat the. transient inductive effects is to use electrolytic capacitors. However, electrolytic capacitors typically have a shorter life expectancy than the contactor circuit.

Prior to the present invention, a need existed to provide a power supply status circuit connected to a contactor circuit that monitors the power supply derived from the holding coil of the contactor. Also, a need existed for maintaining the output of the power supply status circuit while tolerating variations of the derived power supply caused by the inherent transient inductive effect of the contactor's physical and electrical structure.

This invention is designed to resolve these and other problems.

SUMMARY OF THE INVENTION

A power supply status (PSS) circuit is capable of monitoring a derived source of power from a contactor circuit while maintaining the PSS circuit's output. The PSS circuit is capable of tolerating variations in the derived power supply caused by the inherent, transient inductive effects of the contactor's physical and electrical structure.

According to the present invention, a robust PSS circuit has been developed with specific useful features for utilizing power derived from the holding coil of a contactor. As a result, use of the derived power eliminates the need for a separate and additional power supply. Also, the PSS circuit reduces the physical space previously required for filtering components necessary to utilize the derived power supply. In addition, the PSS circuit allows the use of longer lasting filtering components.

The first embodiment of the present invention is directed to a method of immunizing a contactor circuit from the inductive effects of a derived power supply, including: sensing a voltage signal from a power supply, the voltage signal having a switching range comprising an upper voltage and a lower voltage; providing a drive output responsive to the upper voltage; holding the drive output at a constant level as the voltage signal remains above the lower voltage; and, disabling the drive output in response to the voltage signal dropping below the lower voltage.

According to a second embodiment, the invention is directed to a device for immunizing a contactor circuit from the inductive effects of a derived power supply. The device comprising the contactor circuit having an input that receives a voltage signal. The voltage signal having a switching range comprising an upper voltage and a lower voltage. The contactor circuit providing a drive output in response to the voltage signal. The drive output being held at a constant level as the voltage signal remains above the lower voltage; and the drive output being disabled in response to the voltage signal dropping below the lower voltage.

Other advantages and aspects of the present invention will become apparent upon reading the following description of the drawings and detailed description of the invention.

DETAILED DESCRIPTION OF THE PREFERRED EMBODIMENTS

Figure 1:
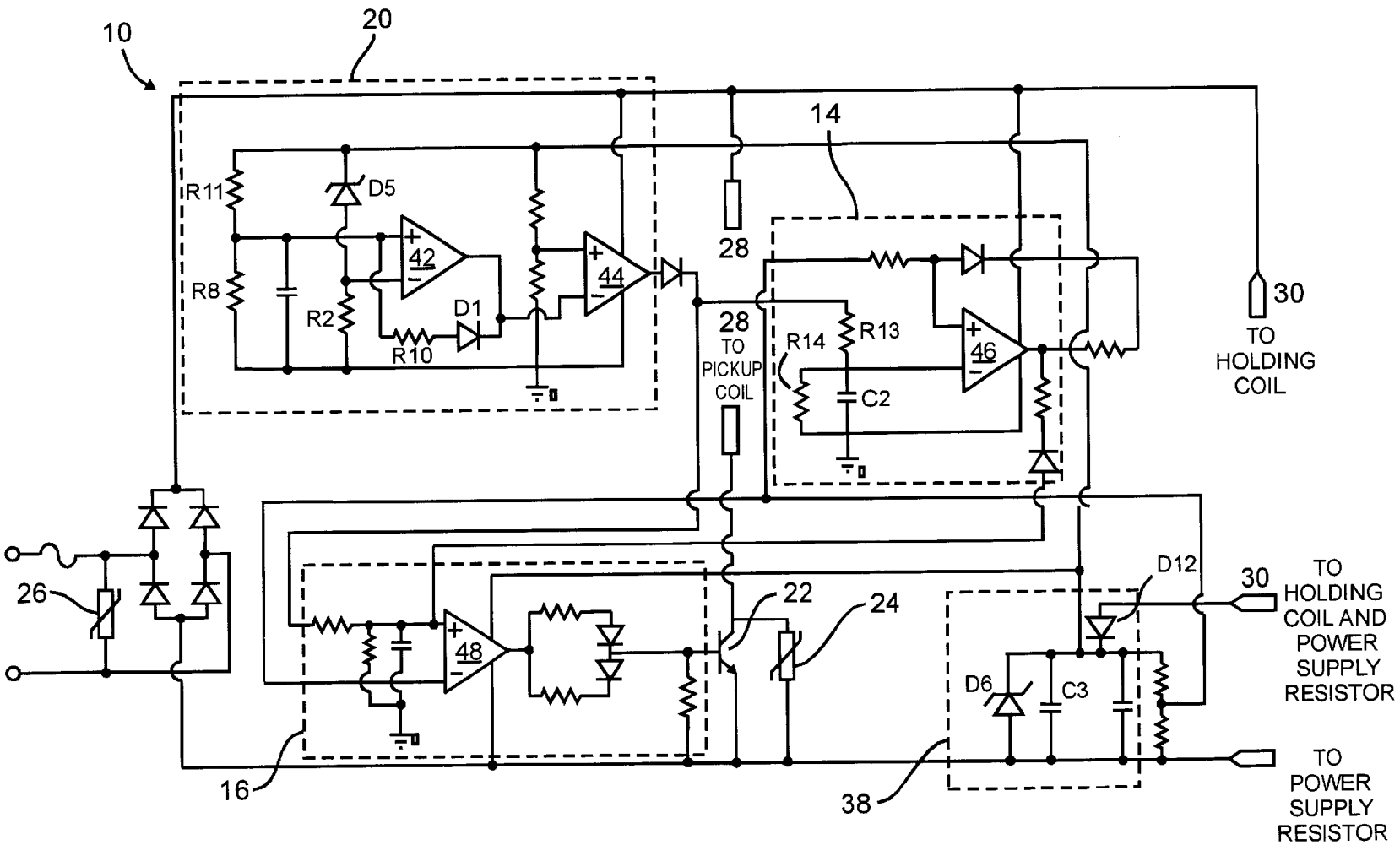
FIG. 1 is a schematic diagram of a contactor circuit.

While this invention is susceptible of embodiments in many different forms, there is shown in the drawings and will herein be described in detail preferred embodiments of the invention. The present disclosure is to be considered as an exemplification of the principles of the invention and is not intended to limit the broad aspect of the invention to the embodiments illustrated.

An electronic coil design utilizes a dual wound DC coil that pulls an armature 32 into the picked up or closed position, and holds the armature 32 in the closed position. The first coil is called the pickup 28, or inrush coil. It is a low impedance, high current coil that generates the large amount of flux, NI, necessary to pull the armature 32 in from the dropped out or open position. The other coil is the holding coil 30. The holding coil 30 is a high impedance, low current coil that generates the smaller amount of flux, NI, necessary to hold the armature 32 in the closed position. The pickup coil 28 should not be allowed to remain continuously on after the armature 32 has been pulled in. The large amount of wattage that the pickup coil 28 generates could thermally damage the coil assembly if it were to remain on. It is the primary purpose of the electronic circuits to turn the pickup coil 28 on until the armature 32 is fully pulled in, and then turn the pickup coil 28 off. The pickup 28 and holding 30 coils have distinct and separate responsibilities; however, the two coils are magnetically coupled by an iron core (armature and magnet) that they share. In some aspects this causes the two coils to act like a transformer.

Contactors or relays that utilize dc coils typically have electronic circuits that are used to control the contactor. Typically, a contactor circuit 10 may contain many components and contactor control sub-circuits, such as: a power supply 38, a timing circuit 14, a gating circuit 16, a power supply status (PSS) circuit 20, an insulated gate bipolar transistor (IGBT) 22 and metal oxide varistors (MOV) 24, 26.

Figure 10:
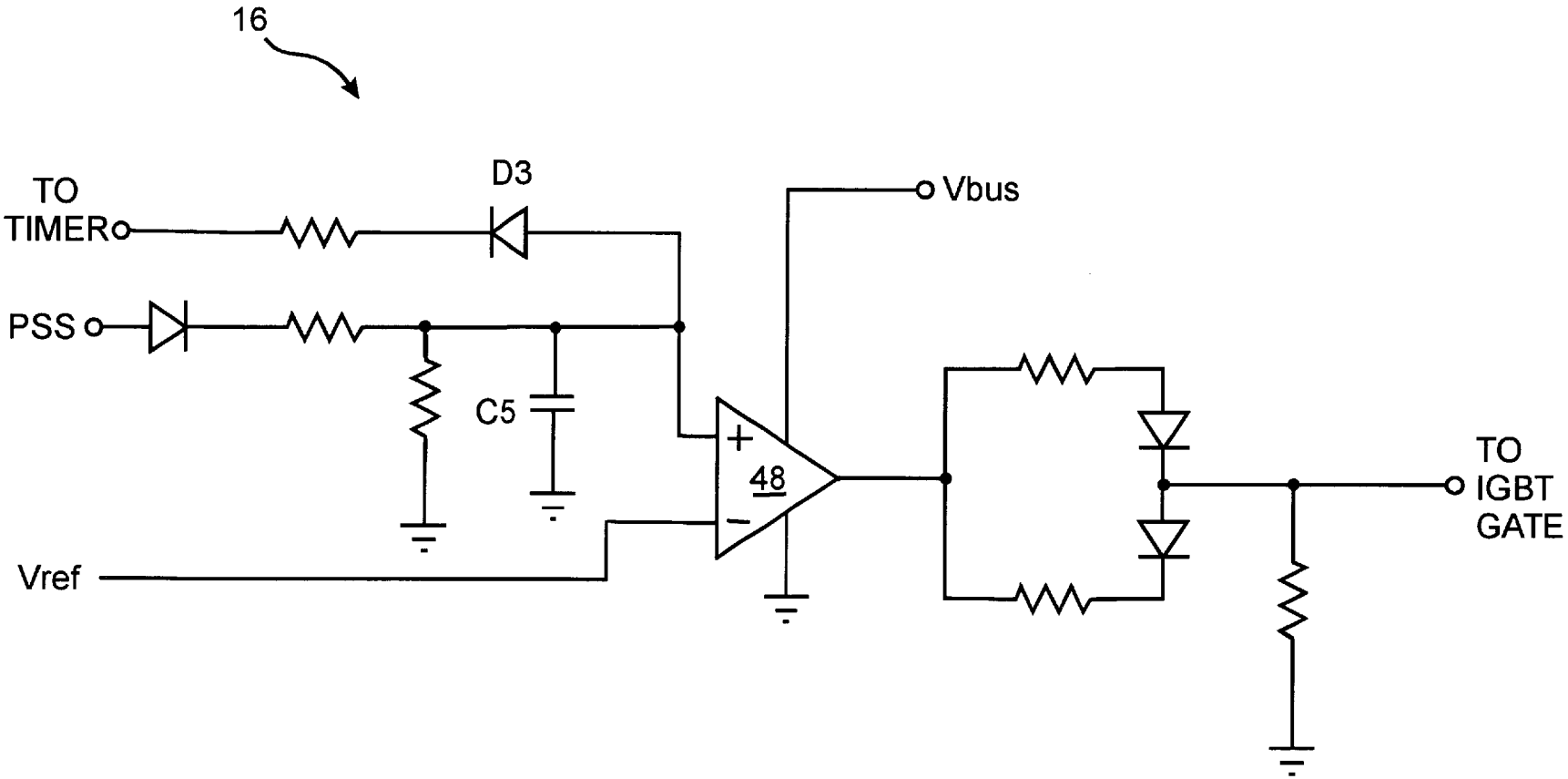
FIG. 10 is a schematic diagram of a gating circuit for a contactor.

The contactor circuit 10, specifically the pickup coil 28, is responsive to the output of the operably connected sub-circuits. As shown in FIG. 1, the sub-circuits and components are operably connected. The gating circuit 16 is responsive to the output of the PSS circuit 20 and the timer circuit 14. FIG. 10. If both outputs of the PSS circuit 20 and the timer circuit 14 are high, the output of the gating circuit's op-amp 48 will be high and the IGBT 22 will be turned on. If either of the outputs from the PSS circuit 20 or the timer circuit 14 is low, the output of the gating circuit's op-amp 48 will be low and the IGBT 22 will be turned off.

Figure 9:
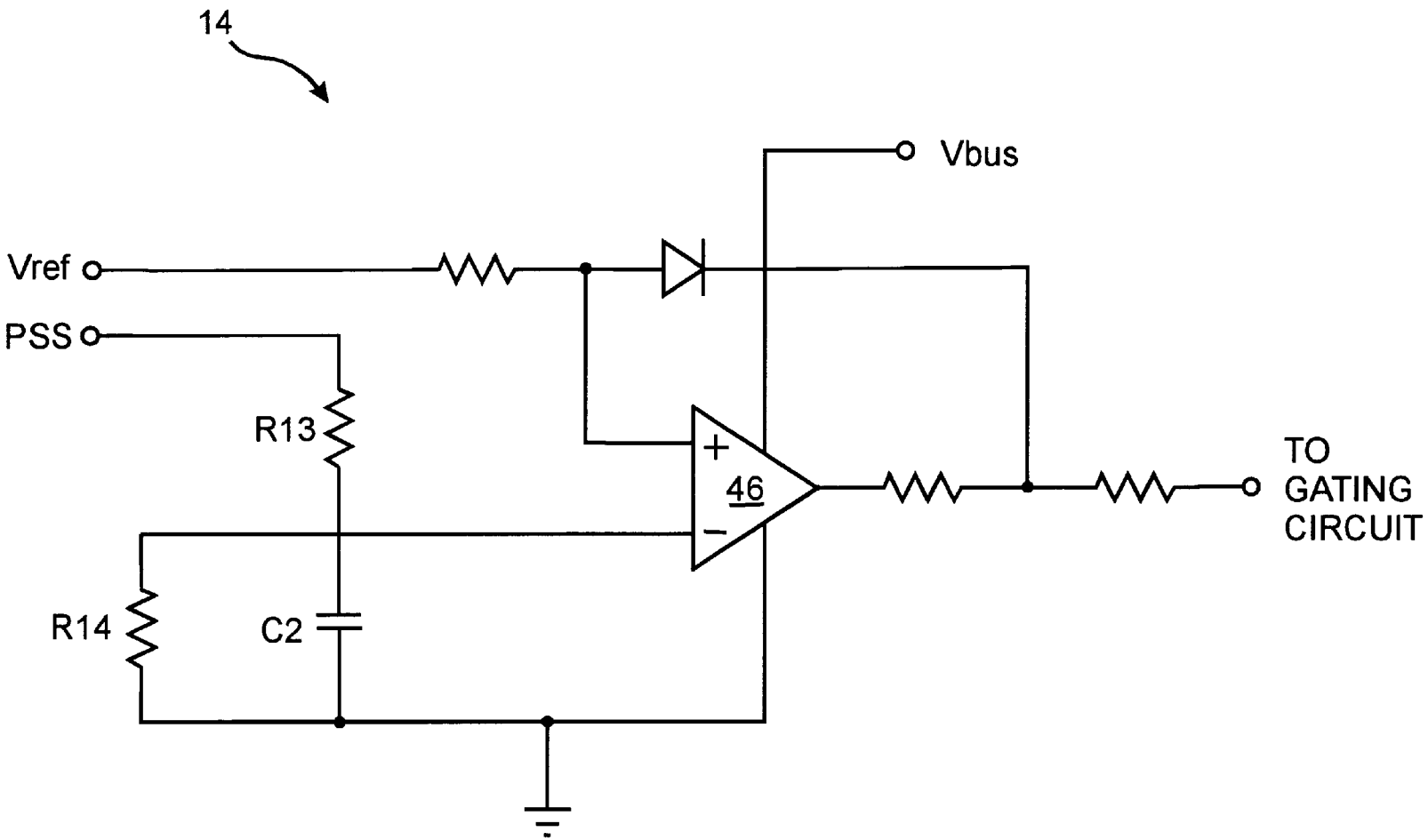
FIG. 9 is a schematic diagram of a timer circuit for a contactor.

The gating circuit 16 controls the operability of the contactor via the electromechanical coils and movement of the armature 32. As the timer circuit 14 output goes low, the gating circuit=s op-amp 48 is switched off. The contactor's timer circuit 14 is derived from a RC timing network (two resistors R13, R14 and capacitor C2), and a single op-amp 46 being used as a comparator. FIG. 9. The capacitor C2 begins charging through resistor R13 as soon as the PSS circuit's output goes high. Resistor R14 affects the time it takes the capacitor C2 to charge as well as providing anti-telegraphing. As power is removed from the circuit 14, approximately 500 milliseconds elapse before sufficient charge drains off capacitor C2 to reset the timer circuit 14 for another operation. This protects the devices from conditions such as fluttering switches. The output of the timer circuit 14 remains high until the voltage across capacitor C2 exceeds the voltage at the non-inverting input of the op-amp 46. At this time, the output of op-amp 46 pulls down low.

The armature 32, magnet 40 and air gap form a magnetic circuit. An electromechanical coil (not shown), supplies NI, or magnetomotive force (MMF), needed to drive the flux in the circuit. The equations below illustrate how the inductance of the circuit is determined by the number of turns of the coil and the reluctance.

$$L = \frac{N^2}{R};$$

where N=number of turns and R=

$$R = \frac{l_{magnet}}{\mu_{magnet} \times A_{magnet}} + \frac{l_{armature}}{\mu_{armature} \times A_{armature}} + \frac{l_{gap}}{\mu_{gap} \times A_{gap}}$$

where A=cross sectional area, and $\mu$=permeability $$L = N^2 \times \frac{1}{\frac{l_{magnet}}{\mu_{magnet} \times A_{magnet}} + \frac{l_{armature}}{\mu_{armature} \times A_{armature}} + \left(\frac{l_{gap}}{\mu_0 \times A_{gap}}\right)}$$

The terms $l_{magnet}$ and $l_{armature}$ are the lengths of the magnetic paths within the armature 32 and magnet 40. These values are fixed and do not change as the air gap changes. The last term (shown in parenthesis) is the reluctance due to the air gap. This last equation illustrates how the inductance of the circuit is controlled by the size of the air gap (position of the armature). As the size of the air gap, $l_{gap}$, reduces, the inductance, L, will increase.

Figure 3:
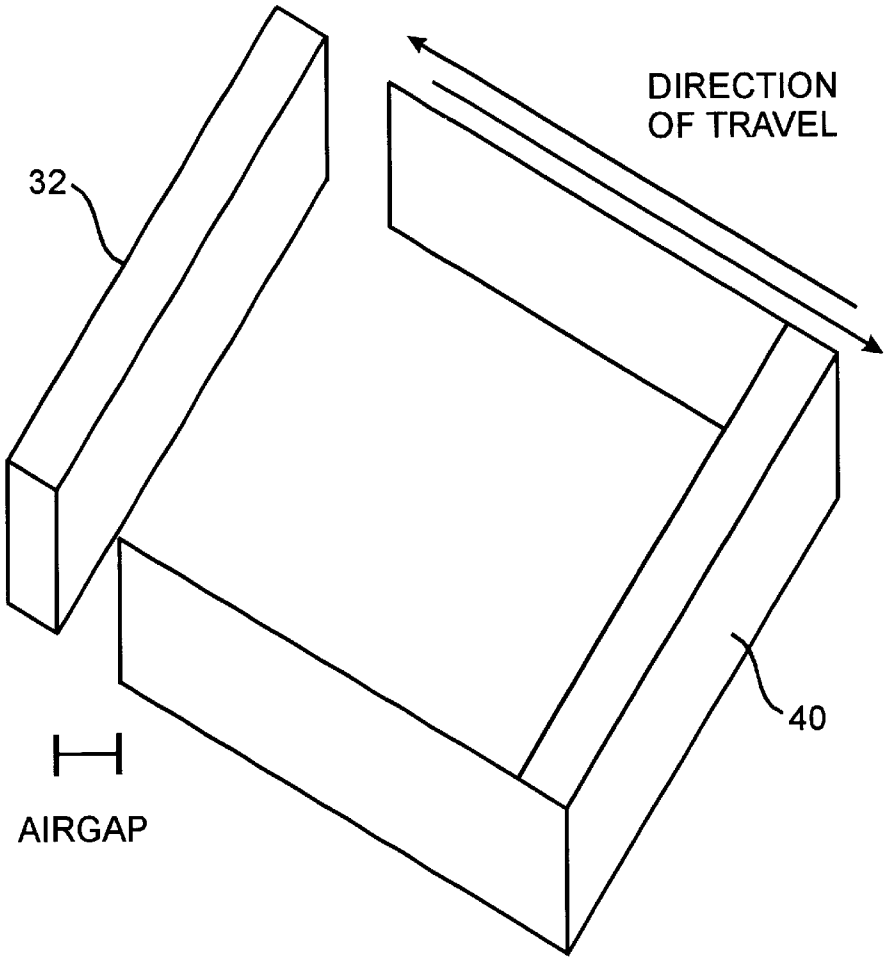
FIG. 3 is a side view of a contactor magnet and armature, the arrows show directional movement of the armature.

The contactor's armature 32 moves during the pickup interval. When the armature 32 is in motion, the air gap between the magnet's face and the armature 32 is no longer fixed. See FIG. 3. As the armature 32 moves closer to the magnet 40, the air gap gets smaller, simultaneously driving the reluctance of the circuit down. The permeability of the flux path (metal and air gap) rises greatly, causing the inductance of the two coils to increase very rapidly. The large change in inductance (dL/dt) that occurs affects the pickup coil current 28. This dL/dt generates a back electromotive force (EMF) that causes the current in the coil to dip and collapse to nearly 0. Once the armature 32 seals, the inductance becomes fixed and the dL/dt goes to 0. This change in inductance is a function of the armature's 32 motion.

Figure 4:
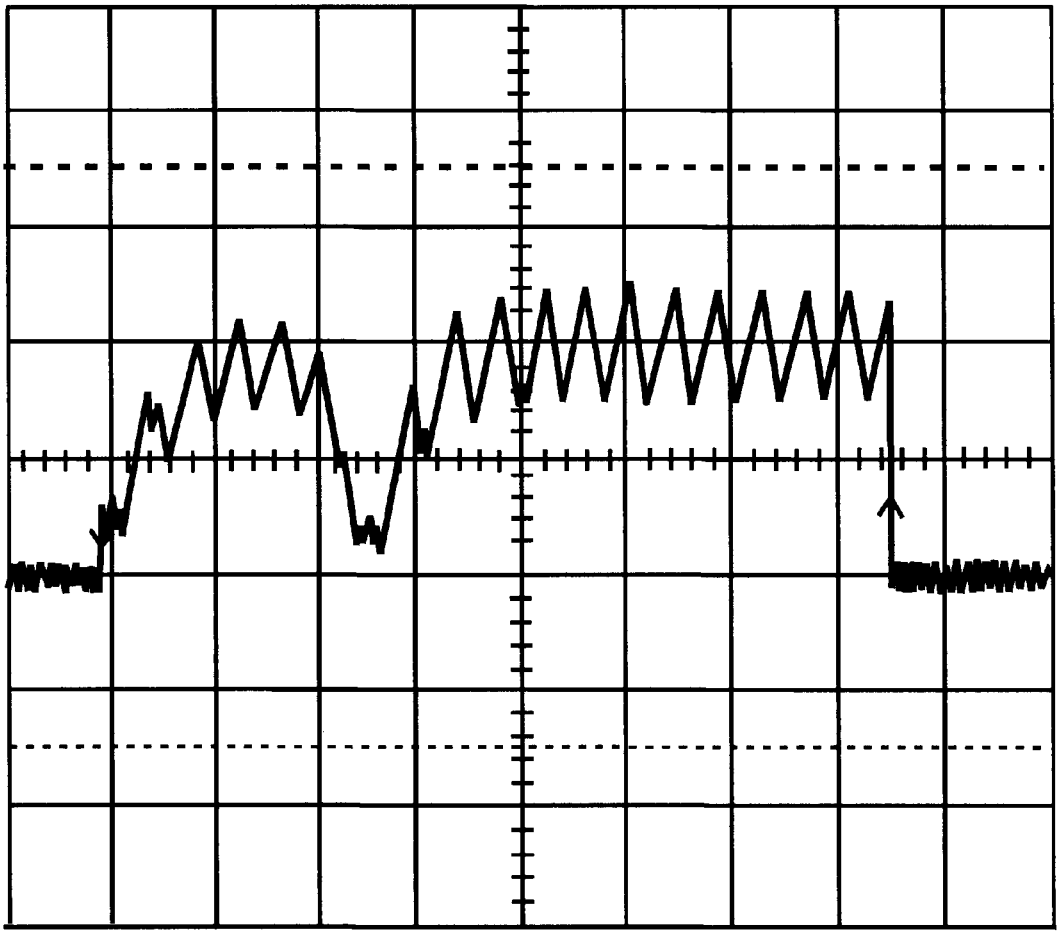
FIG. 4 is a signal trace showing the pickup current when the contactor is operated.

If the circuit's power supply 38 is derived through the holding coil 30, the power supply 38 will dip along with the holding coil current. The power supply 38 may turn the circuit off when the dip occurs; this will cause nuisance tripping. FIG. 4 depicts the pickup current when a device is operated. The current increases when the device is first turned on, decreases to almost 0 when the armature 32 seals closed with the magnet 40, and increases again to steady state until the device is switched off.

Figure 2:
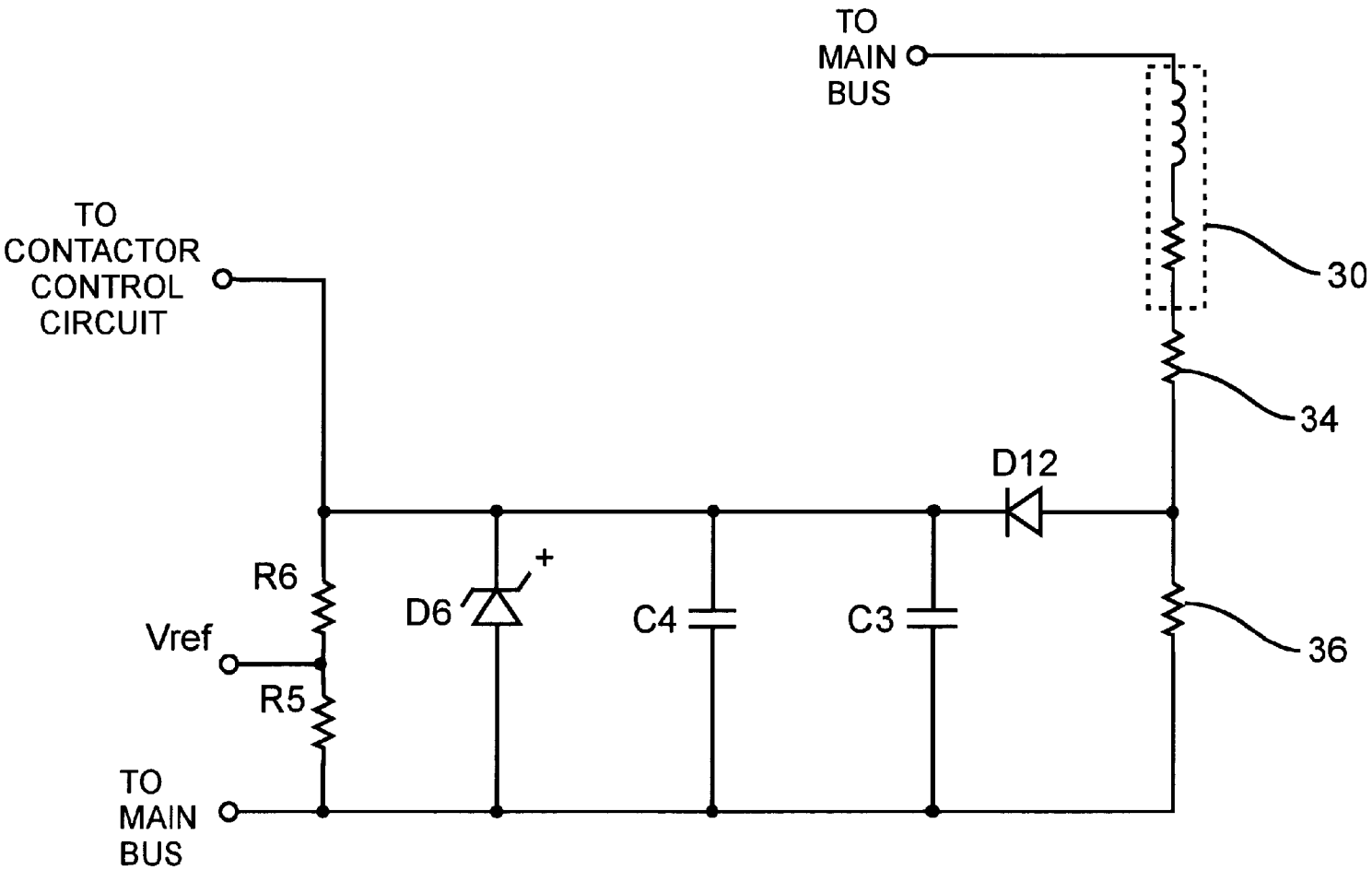
FIG. 2 is a schematic diagram of a contactor circuit.

The holding coil derived power supply 38 provides the power to drive the contactor control circuits that turn the pickup coil 28 ON and OFF. See FIG. 2. A 16V Zener diode D6 is used to provide regulation for the 16V bus that will power the contactor control circuits. There is an additional external power resistor called the power supply resistor 36. This is an eight (8) watt power resistor that is located in a different location from the printed wiring board (PWB). The power supply resistor 36 is placed in parallel with the 16V power supply. This is done to reduce the amount of current that the 16V Zener diode D6 will sink and prevent excessive heating of the component or the potting compound.

Figure 6:
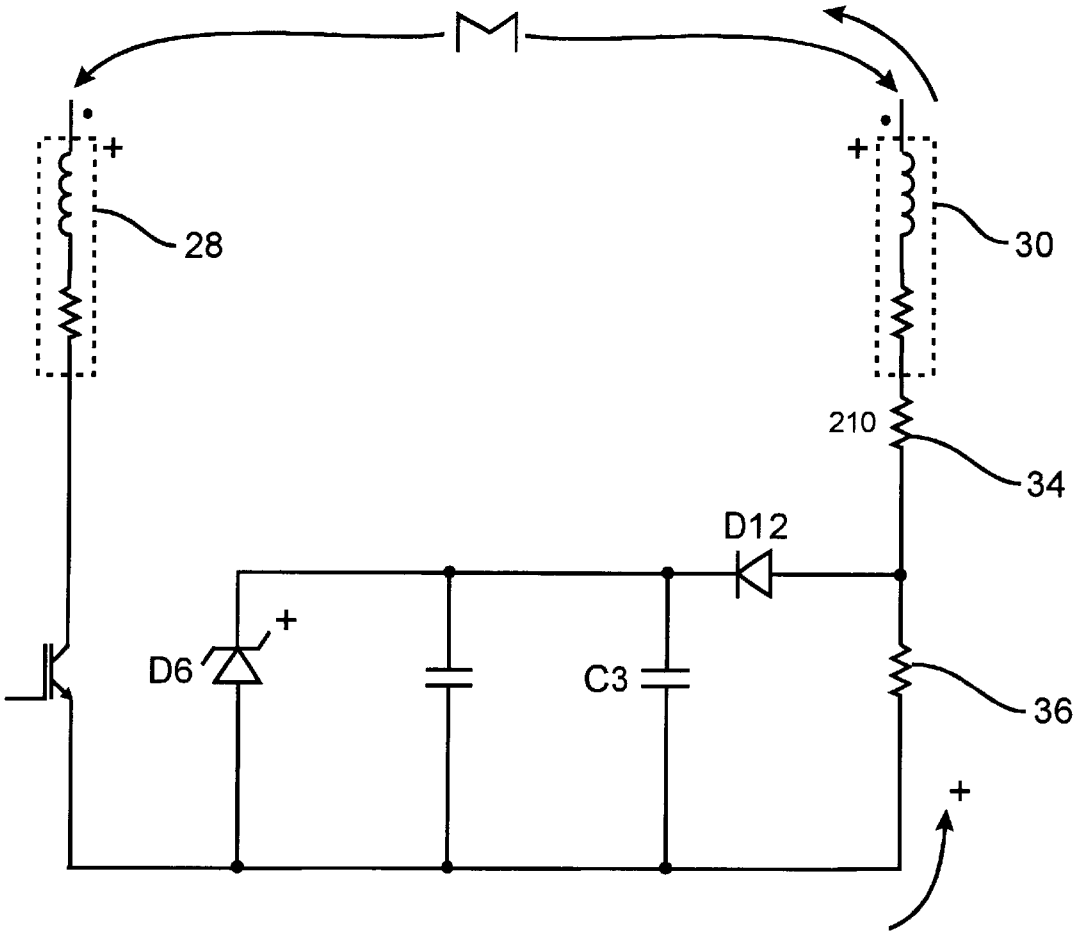
FIG. 6 is a schematic diagram showing the coupling between the pickup coil and the holding coil.

The model shown in FIG. 6 shows the coupling between the pickup coil 28 and the holding coil 30. The holding coil 30 has approximately four times as many turns as the pickup coil 28, so if the coupling were perfect, the holding coil 28 would have an induced voltage approximately four times greater than that applied to the pickup coil 28. The resistance of the pickup coil 28 drops most of the rectified AC bus voltage during inrush; however, when the pickup current falls, the pickup coil inductance voltage increases. It is this voltage across the pickup coils's inductance that couples to the inductance in the holding coil 30.

Figure 5:
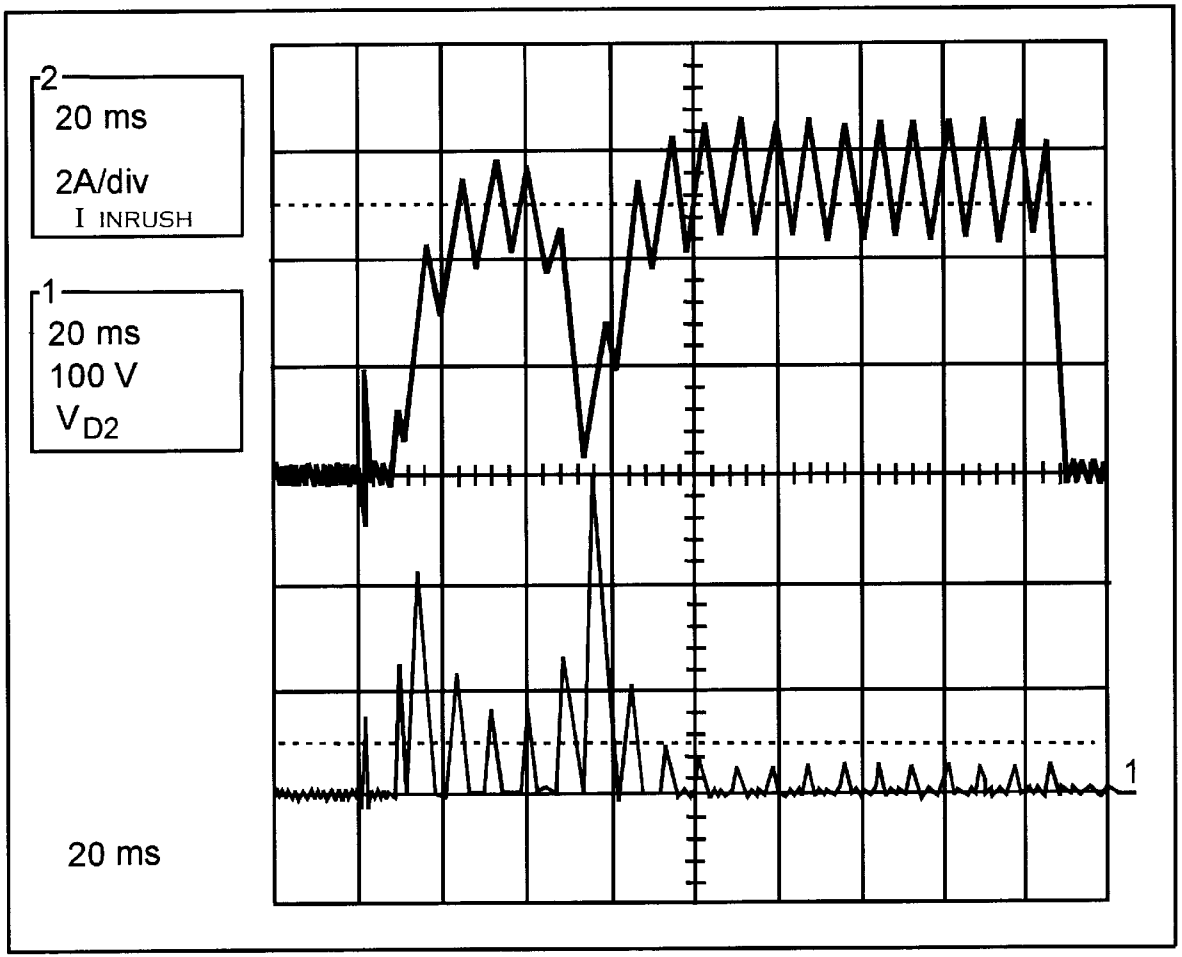
FIG. 5 is a signal trace showing the pickup current when diode D2 is blocking.

In FIG. 5, it can be seen how the voltage across the diode D12 is largest when the pickup coil 28 current is smallest. During the time that the armature 32 seals, the pickup current falls to near 0. At this time, there is maximum voltage coupled to the holding coil 30 inductor. The holding coil's inductor now pushes current in reverse as shown in FIG. 6. The current returns to the holding coil 30 by flowing in through the pickup coil 28, the IGBT 22, the power supply resistor 36, and back to the holding coil 30. It is this current that applies a reverse voltage across the power supply resistor 36 which diode D12 blocks. During this time, the power supply capacitor C3 cannot receive any more charging current; however, the sub-circuits still draw current from the power supply capacitor C3. The voltage across the power supply capacitor C3 decays during this interval.

The contactor's control circuits are designed to tolerate voltage decreases and yet maintain gate voltage on the IGBT 22. Specifically, the PSS circuit 20 must tolerate the dip in power supply voltage while deactivating the circuit if power is removed altogether.

Figure 7:
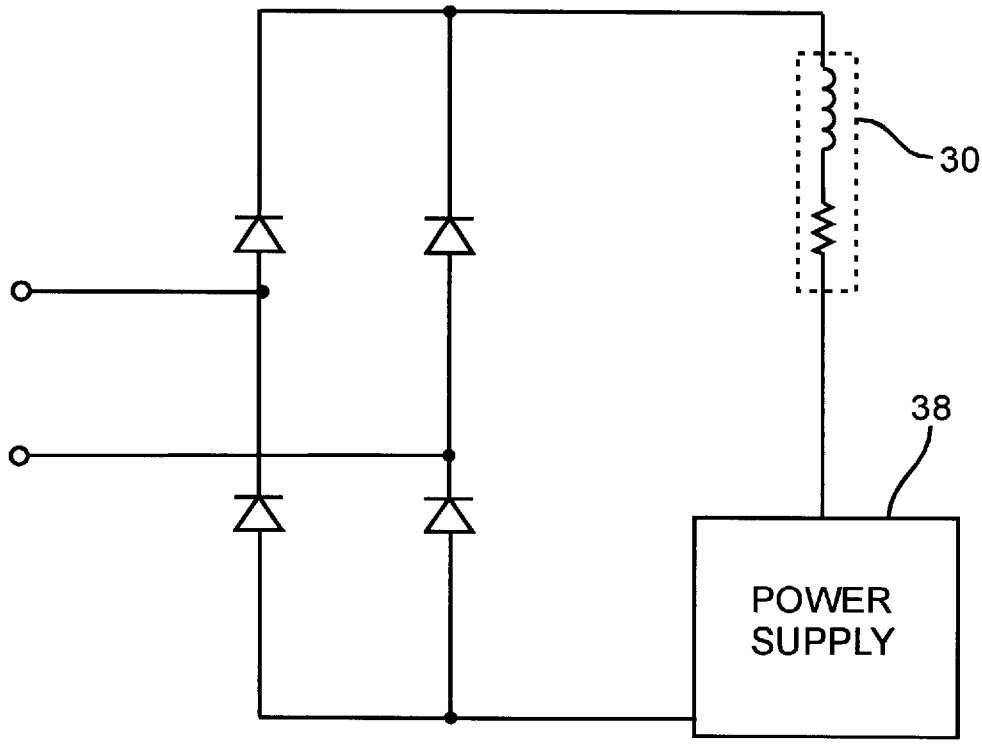
FIG. 7 is a schematic diagram of the preferred embodiment of the invention.

Preferably, it is desired to use a source of power for an electrical circuit that is stable and free from the effects of transient forces. To conserve space, power for a control circuit may be derived from the holding coil 30 of the contactor circuit 10. The contactor's electromechanical coil has resistance and this resistance can be used as a dropping resistor to derive a power supply for the electronics from the input lines. In addition, an external power resistor, referred to as the economizing resistor 34, is used in conjunction with the holding coil 30 to dissipate some of the wattage that would otherwise need to be handled by the holding coil 30. See FIG. 2. A diagram of the power supply topology is shown in FIG. 7.

When the coil resistance is used for the power supply, the power supply is exposed to transients generated by the movement of the armature 32. Due to the transient effects inherent within the contactor circuit 10, the functionality of the contactor's control circuit will be adversely affected.

It is now clear that the dL/dt cannot be avoided on these type of power supplies, so a method must be devised that will keep it from being a problem. If the electronics of the contactor circuit are designed to be robust enough to ignore the power supply dip due to the dL/dt phenomenon, the power supply derived from the coil resistance can be utilized.

Figure 8:
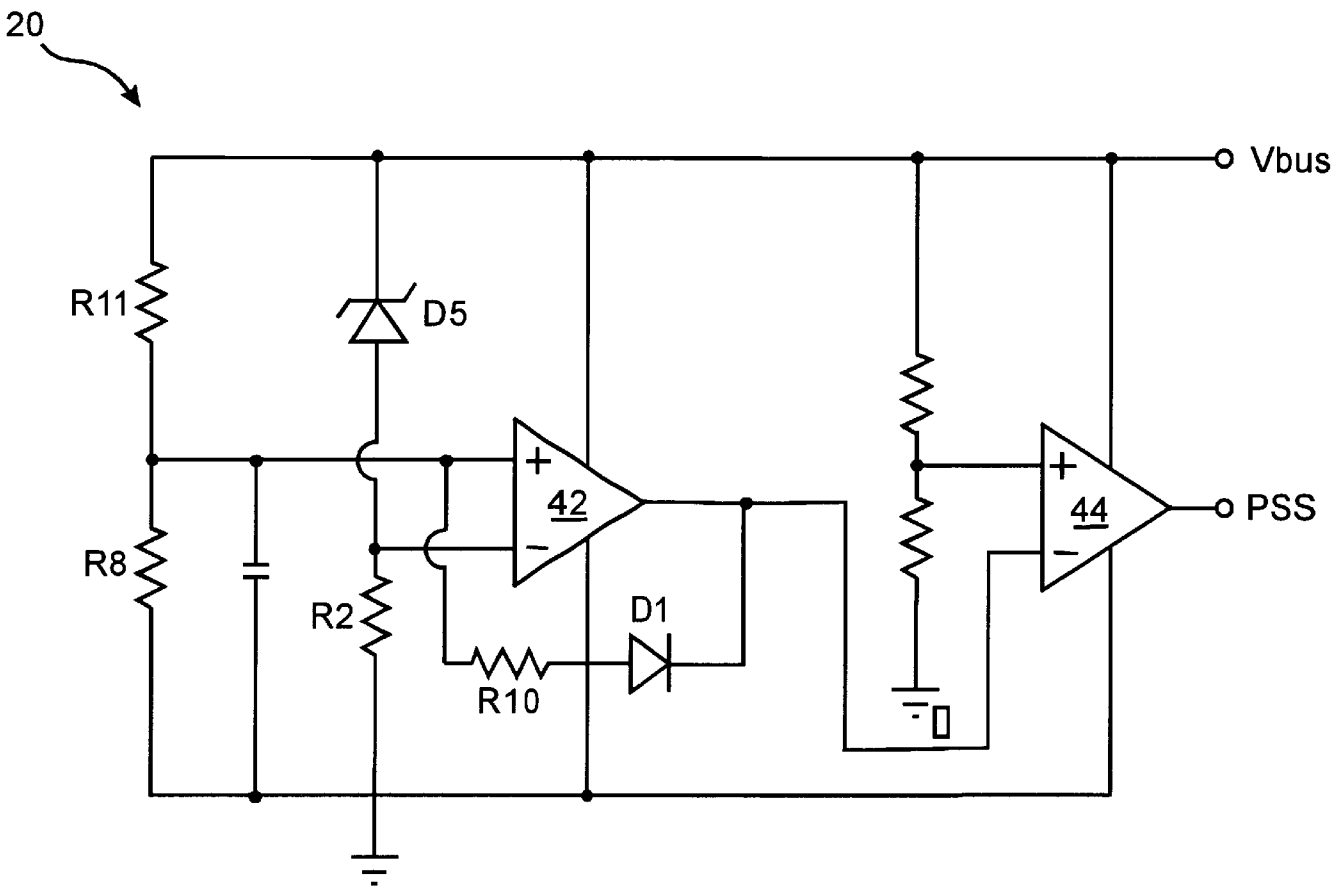
FIG. 8 is a schematic diagram of the preferred embodiment of the power supply status circuit for a contactor.

The circuit that allows the electronics to tolerate the dL/dt transient is the PSS circuit 20. FIG. 8. As power is first applied to the circuit 20, the power supply, $V_{BUS}$, charges up. Once $V_{BUS}$ charges to 12.5 volts nominally, the PSS signal goes high. The PSS signal will remain high until $V_{BUS}$ drops below 6.5 volts nominally. This allows the power supply to sag by over 6 volts and still not toggle the PSS output low. Allowing the power supply to sag by this amount, allows the power supply capacitor C3 to be much smaller. Utilizing a smaller power supply capacitor C3 allows the capacitor itself to be a tantalum capacitor which has no known wear out mechanisms. This is important because contactors generally have long life expectancies; twenty (20) or more years is not uncommon. If a large capacitor was placed on the power supply to completely eliminate the power supply dip, much more board space would be required, or possibly an electrolytic capacitor would be required. Electrolytic capacitors have wear out mechanisms and usually much shorter lives than tantalum capacitors.

The circuit 20 utilizes hysteresis to control the gating of the IGBT 22 that turns on the contactors's pickup coil 28. The circuit 20 senses when there is sufficient voltage available on the power supply and then drives the IGBT 22 to turn on. This hysteresis is implemented within the PSS circuit 20 to control the gating of the IGBT 22 that actuates the contactor's pickup coil. The PSS circuit 20 delays until there is sufficient voltage available from the derived power supply before sending a drive output to turn the IGBT 22 on. Once the IGBT 22 is turned on, the PSS circuit 20 will remain high unless the power supply dips below approximately 6.5 volts. The only way the derived power supply will decrease below this value is if the user commands the circuit to turn off. When the user commands the circuit to turn off, $V_{BUS}$ will decrease so that the PSS circuit will rapidly drop its output signal low, thus ensuring the circuit's turn off. The hysteresis enables the circuit to tolerate the effects of dL/dt associated with the derived power supply; and it also makes the circuit very resilient to electrical noise.

The equations for selecting the values of $V_{BUS}$ that will toggle the state of the PSS circuit 20 are listed below. Using these equations allows the user to optimized the circuit 20 for each specific application.

$$V_{BUS} = V_{D5} \times \frac{R_8 + R_{11}}{R_{11}}$$

$$V_{BUS} = 12.5 \text{ V}$$

When PSS is low, 12.5 V is the value of $V_{BUS}$ that causes PSS to switch from low to high.

$$V_{BUS} = \frac{5.6 \times (R_8 + R_{10}) + 5.6 \times (R_{10} + R_{11}) + 5.6 \times (R_8 + R_{11}) + V_{DI} \times (R_8 + R_{11})}{R_{11} \times (R_8 + R_{10})}$$

$$V_{BUS} = 6.5 \text{ V}$$

When PSS is high, 6.5 V is the value of $V_{BUS}$ that causes PSS to switch from high to low.

A first op-amp 42 acts as a comparator. Two resistors R8, R11 form a voltage divider that determines the voltage at the non-inverting input terminal of the op-amp 42. The voltage at the inverting terminal of the op-amp 42 is determined by the Zener diode D5 in series with a resistor R2. The diode D5 does not allow any current to flow through the resistor R2 until the voltage on VBUS exceeds the 5.6 V required to avalanche the diode D5. This maintains the voltage at the inverting input of the op-amp 42 at approximately 0 volts until VBUS exceeds 5.6 V. The diode D5 and the resistor R2 ensure that the output of the op-amp 42 is high when $V_{BUS}$ initially begins to charge up. Once $V_{BUS}$ exceeds 5.6 V, the voltage at the inverting and non-inverting pins of the op-amp 42 are as follows:

$$V_{INV} = V_{BUS} - 5.6\ \text{V}$$

$$V_{NON\text{-}INV} = V_{BUS} \times \frac{R_8}{R_8 + R_{11}}$$

The equations for the inputs of the op-amp 42 can be set equal to each other to solve for the value of $V_{BUS}$ where the output of the comparator 42 will switch from high to low. As mentioned earlier, this occurs when $V_{BUS}$ equals 12.5 V.

Once the output of the op-amp 42 switches low, diode D1 is forward biased and resistor R10 is placed in the feedback path back to the non-inverting input. The feedback creates hysteresis and lowers the voltage at the non-inverting input of the comparator 42 so that $V_{BUS}$ must now fall lower than 12.5 V to cause the output of the comparator 42 to toggle back to high. The voltage at the non-inverting input is defined by:

$$V_{NON\text{-}INV} = (V_{BUS} \times R_{10} + V_{OUT} \times R_{11} + V_{D1} \times R_{11}) \times \frac{R_8}{R_8 \times R_{10} + R_{11} \times R_{10} + R_{11} \times R_8}$$

The diode D1 is preferably a Schottky diode. Substituting 0.4 V for $V_{D1}$, 0 V for $V_{OUT}$, and the proper values for R8, R10, and R11; the voltage at non-inverting input of the comparator 42 is:

$$V_{NON\text{-}INV}=0.84\times V_{BUS}+0.339$$

Since the voltage at the inverting input of the comparator 42 is known, the value of $V_{BUS}$ that will toggle the output of the comparator 42 to high again can be determined.

$$V_{NON\text{-}INV}=V_{INV}$$

$$0.084\times V_{BUS}+0.339=V_{BUS}-5.6$$

$$V_{BUS}=6.5\text{V}$$

The second op-amp 44 acts as an inverter. This op-amp 44 has its non-inverting input established by a voltage divider. The voltage divider is equal to approximately $0.195AV_{BUS}$. When the output of the comparator op-amp 42 is low, the output of the inverter op-amp 44 is high.

While the specific embodiments have been illustrated and described, numerous modifications come to mind without significantly departing from the spirit of the invention and the scope of protection is only limited by the scope of the accompanying claims.

We claim:

1. A method of immunizing a contactor circuit from the inductive effects of a contactor coil derived power supply, comprising the steps of:

sensing a voltage signal from the contactor coil, the voltage having a switching range comprising an upper voltage and a lower voltage;

providing a drive output responsive to the upper voltage;

holding the drive output at a constant level as the voltage signal remains above,the lower voltage; and, disabling the drive output in response to the voltage signal dropping below the lower voltage.

2. A device for immunizing a contactor circuit from the inductive effects of a contactor coil derived power supply, comprising;

the circuit having an input that receives a voltage signal;

the voltage signal having a switching range comprising an upper voltage and a lower voltage;

the circuit providing a drive output in response to the voltage signal;

the drive output being held at a constant level as the voltage signal remains above the lower voltage; and, the drive output being disabled in response to the voltage signal dropping below the lower voltage.

3. A method of immunizing a contactor control circuit from the inductive effects of a holding coil derived power supply, comprising the steps of:

sensing a voltage signal from the holding coil, the voltage having a predetermined upper level and a predetermined lower level;

providing a HIGH output responsive to the upper level;

holding the HIGH output as the sensed voltage signal remains above the predetermined lower level; and, disabling the HIGH output in response to the sensed holding coil voltage signal dropping below the predetermined lower level.

4. A contactor control circuit arrangement comprising:

a pull-in coil selectively connected electrically in series with a main bus;

a holding coil electrically connected in series with the main bus;

a power supply for providing power to a contactor control circuit, the power supply having an input electrically connected to one terminal of the holding coil and an output electrically connected to the contactor control circuit;

the contactor control circuit comprising:

a power supply status circuit for sensing a voltage of the holding coil and providing a HIGH output after the holding coil voltage reaches a first predetermined level and a LOW output when the holding coil voltage drops below a second predetermined level;

a timer circuit providing a High output for a predetermined period of time after the power supply status circuit output becomes HIGH; and, a gating circuit responsive to both the timer circuit output and the power supply status circuit output, the gating circuit selectively connecting the pull-in coil electrically in series with the main bus only when both the timer circuit output and the power supply status circuit output are HIGH.

5. The control circuit arrangement of claim 4, wherein the power supply includes a capacitor.

6. The control circuit arrangement of claim 5, wherein the capacitor is a tantalum capacitor.

* * * * *